US010801223B1

(12) United States Patent
Zailian

(10) Patent No.: US 10,801,223 B1
(45) Date of Patent: Oct. 13, 2020

(54) MODULAR BUILDING

(71) Applicant: Johnny Angel Zailian, Glendale, AZ (US)

(72) Inventor: Johnny Angel Zailian, Glendale, AZ (US)

( * ) Notice: Subject to any disclaimer, the term of this patent is extended or adjusted under 35 U.S.C. 154(b) by 0 days.

(21) Appl. No.: 16/543,131

(22) Filed: Aug. 16, 2019

(51) Int. Cl.
*E04H 1/00* (2006.01)
*E04H 1/02* (2006.01)

(52) U.S. Cl.
CPC ..... *E04H 1/005* (2013.01); *E04H 1/02* (2013.01)

(58) Field of Classification Search
CPC ..... E04H 1/005; E04H 1/02; E04H 1/1205; E04B 2001/0092; E04B 1/3412; E04B 7/028
USPC ..... 52/73, 79.1, 79.4, 82, 169.4, 223, 230, 52/234, 236.1, 236.2, 237, 294–296, 426, 52/745.06
See application file for complete search history.

(56) References Cited

U.S. PATENT DOCUMENTS 3,152,366 A * 10/1964 McCrory ..... E04B 1/10 52/79.4
3,255,990 A * 6/1966 Williams ..... E04G 13/02 249/27
3,408,777 A * 11/1968 Ghirelli ..... E04B 1/3465 52/1
3,452,493 A * 7/1969 Mims ..... E04H 1/02 52/73
3,600,865 A * 8/1971 Vanich ..... E04B 1/3404 52/73
3,633,325 A * 1/1972 Bartoli ..... E04B 7/028 52/73
3,921,354 A * 11/1975 Connelly ..... E04B 2/62 52/236.1
4,100,705 A * 7/1978 Diana ..... E04B 1/04 52/236.1
4,261,149 A * 4/1981 Gustafson ..... E04B 1/34352 52/292

(Continued)

FOREIGN PATENT DOCUMENTS

DE 2945279 A1 * 5/1981 ..... E04B 1/3412

OTHER PUBLICATIONS

Machine translation of foreign reference DE 2945279, obtained from https://translationportal.epo.org/emtp/translate/?ACTION=description-retrieval&COUNTRY=DE&ENGINE=google&FORMAT=docdb&KIND=A1&LOCALE=en_EP&NUMBER=2945279&SRCLANG=de&TRGLANG=en (last accessed on Jun. 23, 2020) (Year: 2020).*

*Primary Examiner* — Theodore V Adamos
(74) *Attorney, Agent, or Firm* — Parsons & Goltry; Robert Parsons; Michael Goltry

(57) ABSTRACT

A modular unit including a concrete pad and a base support affixed to the pad. An anchor collar affixed to the base support and defining spaced apart grooves with a multi-arm beam positioned in the collar, one arm in each of the grooves and extending radially outwardly from the collar. Floor sections affixed to the multi-arm beam to form a floor disc. Wall panels affixed to the floor disc and spaced apart around the periphery to define a wall. Each panel having channeled edges. A plurality of window inserts engaged in opposed channeled edges of adjacent wall panels. A retaining ring extending around the wall and having a downwardly opening groove engaged with an upper edge of each window insert and fixedly attached to an upper edge of each of the wall panels. A roof and roof support structure affixed to the roof.

19 Claims, 22 Drawing Sheets

(56) References Cited

U.S. PATENT DOCUMENTS

| | | | | | |
|---|---|---|---|---|---|
| 4,332,116 | A * | 6/1982 | Buchanan | E04B 1/24 | 52/126.6 |
| 5,031,371 | A * | 7/1991 | Davister | E04B 1/10 | 403/170 |
| 5,267,420 | A * | 12/1993 | Segman | E04B 1/0007 | 52/236.1 |
| 5,522,186 | A * | 6/1996 | Jarman | E04B 1/3404 | 182/187 |
| 5,860,258 | A * | 1/1999 | Faith | E04H 1/02 | 52/236.2 |
| 6,457,280 | B1 * | 10/2002 | Park | E03C 1/00 | 52/65 |
| 6,857,245 | B2 * | 2/2005 | Choi | E04H 3/02 | 40/427 |
| 9,896,834 | B1 * | 2/2018 | Hyams | E04B 1/3404 | |
| 2002/0046518 | A1 * | 4/2002 | Eguchi | E04H 5/02 | 52/220.1 |
| 2007/0214733 | A1 * | 9/2007 | Braun | E04H 3/02 | 52/79.6 |
| 2012/0036795 | A1 * | 2/2012 | Correa | E04B 7/028 | 52/82 |

* cited by examiner

MODULAR BUILDING

FIELD OF THE INVENTION

This invention relates to building construction and more specifically to modular building construction.

BACKGROUND OF THE INVENTION

Modular buildings have been proposed for a long time. However, all of the modular buildings known to the inventor are box-like structures that are positioned on the ground or on a cement slab and are either positioned horizontally adjacent and/or are stacked vertically to form a larger structure. Generally, these prior art modular structures are not very attractive and are associated almost exclusively with work places or very cheap housing. Also, the prior art structures are generally easy to break into and are subject to any natural occurrences, even relatively small floods and winds.

It would be highly advantageous, therefore, to remedy the foregoing and other deficiencies inherent in the prior art.

Accordingly, it is an object of the present invention to provide a new and improved modular building.

It is another object of the present invention to provide a new and improved modular building that is attractive and practical.

It is another object of the present invention to provide a new and improved modular building that is easier to protect against break-ins, small natural occurrences, etc.

SUMMARY OF THE INVENTION

Briefly to achieve the desired objects and advantages of the instant invention a modular unit or element includes a concrete pad having an upper surface, a base support affixed to the upper surface of the concrete pad, and an anchor collar affixed to the base support. The anchor collar defines spaced apart grooves and a multi-arm beam is positioned in the anchor collar with one arm of the multi-arms positioned in each of the spaced apart grooves so as to extend radially outwardly from the anchor collar. A plurality of floor sections are affixed to the multi-arm beam, one each floor section of the plurality of floor sections affixed between adjacent arms of the multi-arm beam to form a floor disc for the modular unit or element. The floor disc defines an outer periphery of the modular unit or element. A plurality of wall panels are affixed to outer portions of the floor disc, the plurality of wall panels being spaced apart around the outer periphery of the floor disc and oriented in an upwardly directed position to define a peripheral wall around the floor disc. Each wall panel of the plurality of wall panels has channeled edges on each opposite vertical edge. A plurality of window inserts, one each, are engaged in opposed channeled edges of adjacent wall panels. A retaining ring extends around the peripheral wall, the retaining ring having a downwardly opening groove engaged with an upper edge of each window insert and fixedly attached to an upper edge of each of the plurality of wall panels. A roof and roof support structure are affixed to the roof, the roof includes a grid defining a ceiling for the modular unit or element.

The desired objects and advantages of the instant invention are further achieved in a preferred embodiment of a modular unit or element including a concrete pad having an upper surface, a base support affixed to the upper surface of the concrete pad, and an anchor collar affixed to the base support. The anchor collar defines spaced apart grooves and includes an upwardly directed wall extending around the periphery to define a depression in the center, the spaced apart grooves being cut into the wall down to the surface of the central depression so that the bottoms of the grooves are in a common plane with the bottom of the depression, and a centrally located support rod affixing element is fixedly mounted at the center of depression. A multi-arm beam is positioned in the anchor collar with one arm of the multi-arms positioned in each of the spaced apart grooves so as to extend radially outwardly from the anchor collar. A plurality of floor sections are affixed to the multi-arm beam, one each floor section of the plurality of floor sections affixed between adjacent arms of the multi-arm beam to form a floor disc for the modular unit or element. The floor disc defines an outer periphery of the modular unit or element. A plurality of wall panels are affixed to outer portions of the floor disc, the plurality of wall panels being spaced apart around the outer periphery of the floor disc and oriented in an upwardly directed position to define a peripheral wall around the floor disc, each wall panel of the plurality of wall panels having channeled edges on each opposite vertical edge. A plurality of window inserts, one each engaged in opposed channeled edges of adjacent wall panels. A retaining ring extends around the peripheral wall, the retaining ring having a downwardly opening groove engaged with an upper edge of each window insert and fixedly attached to an upper edge of each of the plurality of wall panels, the retaining ring having a flange extending at least partially around the periphery. Roof support structure includes a roof support rod having a lower end engaged with the centrally located support rod affixing element and an upper end extending vertically upwardly beyond the retaining ring. A roof has a flange extending around the outer periphery and mating with and fixedly engaged with the retaining ring flange and the roof engaged with the roof support rod. The roof includes a grid defining a ceiling for the modular unit or element.

The desired objects and advantages of the instant invention are further achieved in a method of constructing a modular unit or element comprising the steps of providing a concrete pad having an upper surface, affixing a base support to the upper surface of the concrete pad, and affixing an anchor collar to the base support, the anchor collar defining spaced apart grooves. A step of positioning a multi-arm beam in the anchor collar with one arm of the multi-arms positioned in each of the spaced apart grooves so as to extend radially outwardly from the anchor collar is next and a step of affixing a plurality of floor sections to the multi-arm beam, one each floor section of the plurality of floor sections affixed between adjacent arms of the multi-arm beam to form a floor disc for the modular unit or element, the floor disc defining an outer periphery of the modular unit or element follows. A step of affixing a plurality of wall panels to outer portions of the floor disc, the plurality of wall panels being spaced apart around the outer periphery of the floor disc and oriented in an upwardly directed position to define a peripheral wall around the floor disc. Each wall panel of the plurality of wall panels has channeled edges on each opposite vertical edge. The method includes a step of engaging a plurality of window inserts, one each in opposed channeled edges of adjacent wall panels, attaching a retaining ring around the peripheral wall, the retaining ring having a downwardly opening groove engaged with an upper edge of each window insert and fixedly attached to an upper edge of each of the plurality of wall panels, and providing a roof and affixing a roof support structure to the roof. The roof includes a grid defining a ceiling for the modular unit or element.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF THE DRAWINGS

Figure 1:
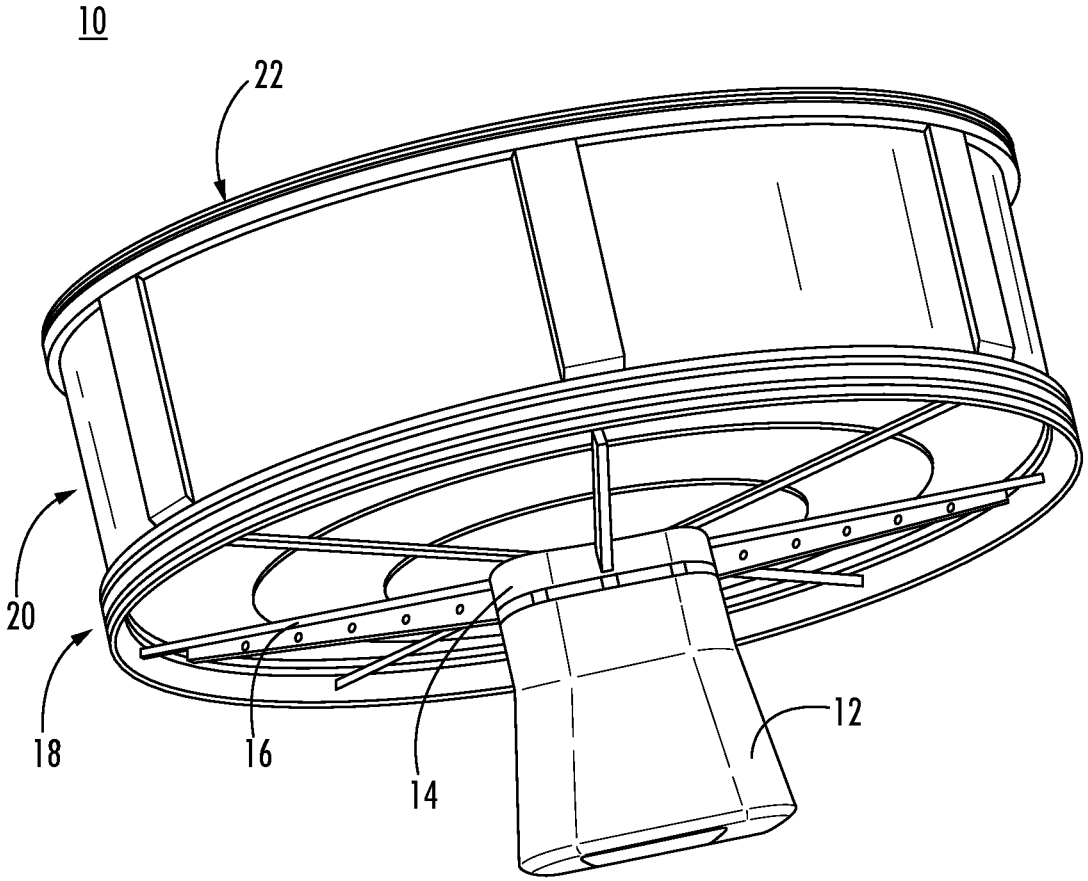
FIG. 1 is a perspective side view of a single modular element in accordance with the present invention.
Figure 2:
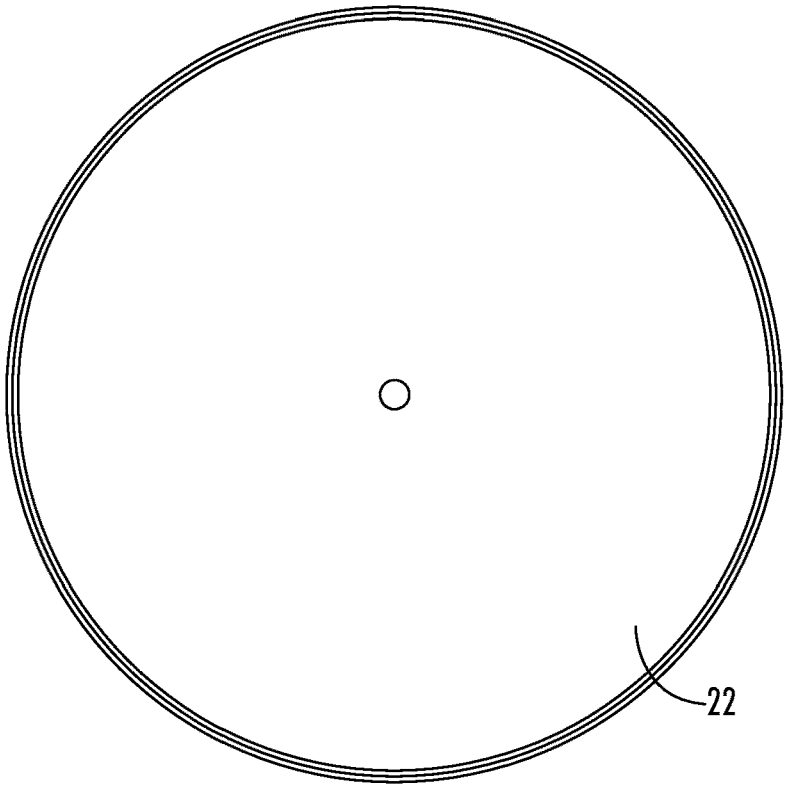
FIG. 2 is a top view of the modular element of FIG. 1.
Figure 3:
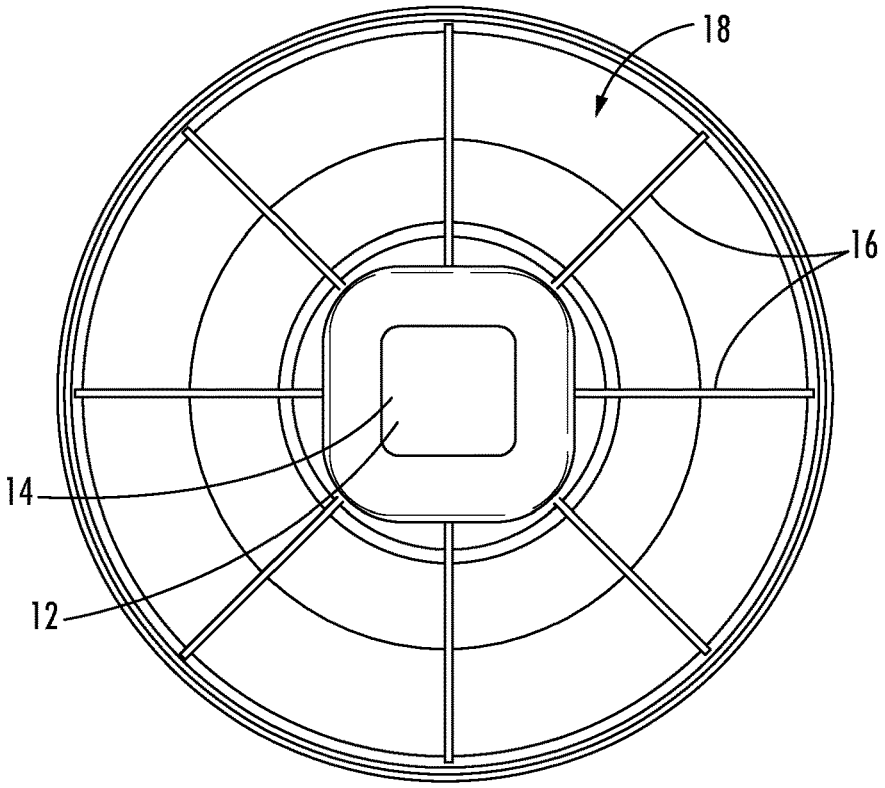
FIG. 3 is a bottom side view of the modular element of FIG. 1.

Turning now to the drawings in which like reference characters indicate corresponding elements throughout the several views, attention is directed to FIGS. 1, 2, and 3 which illustrate a single modular element 10, in accordance with the present invention. Modular element 10 includes a base support 12, a grooved anchor collar 14, a multi-arm beam (in this specific example a quad beam 16), a floor 18, walls 20, and a roof 22 (FIG. 3). It will be understood from the following description that modular element 10 is a complete unit and can be used alone or with additional modular elements 10, as will be explained in more detail below.

Figure 4:
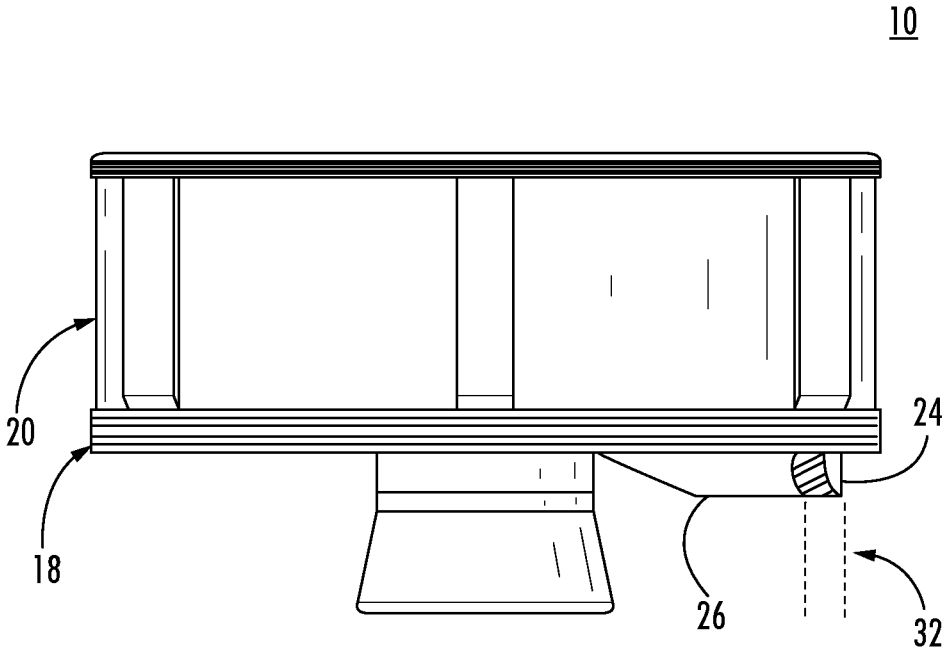
FIG. 4 is a left side view of the modular element of FIG. 1, illustrating an entry enclosure.
Figure 5:
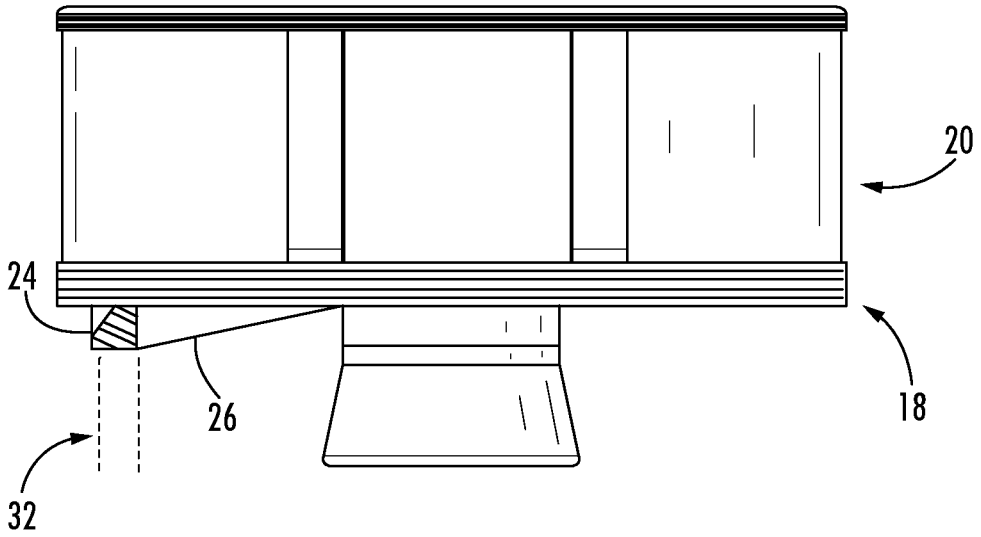
FIG. 5 is a right side view of the modular element of FIG. 1, illustrating the entry enclosure.
Figure 6:
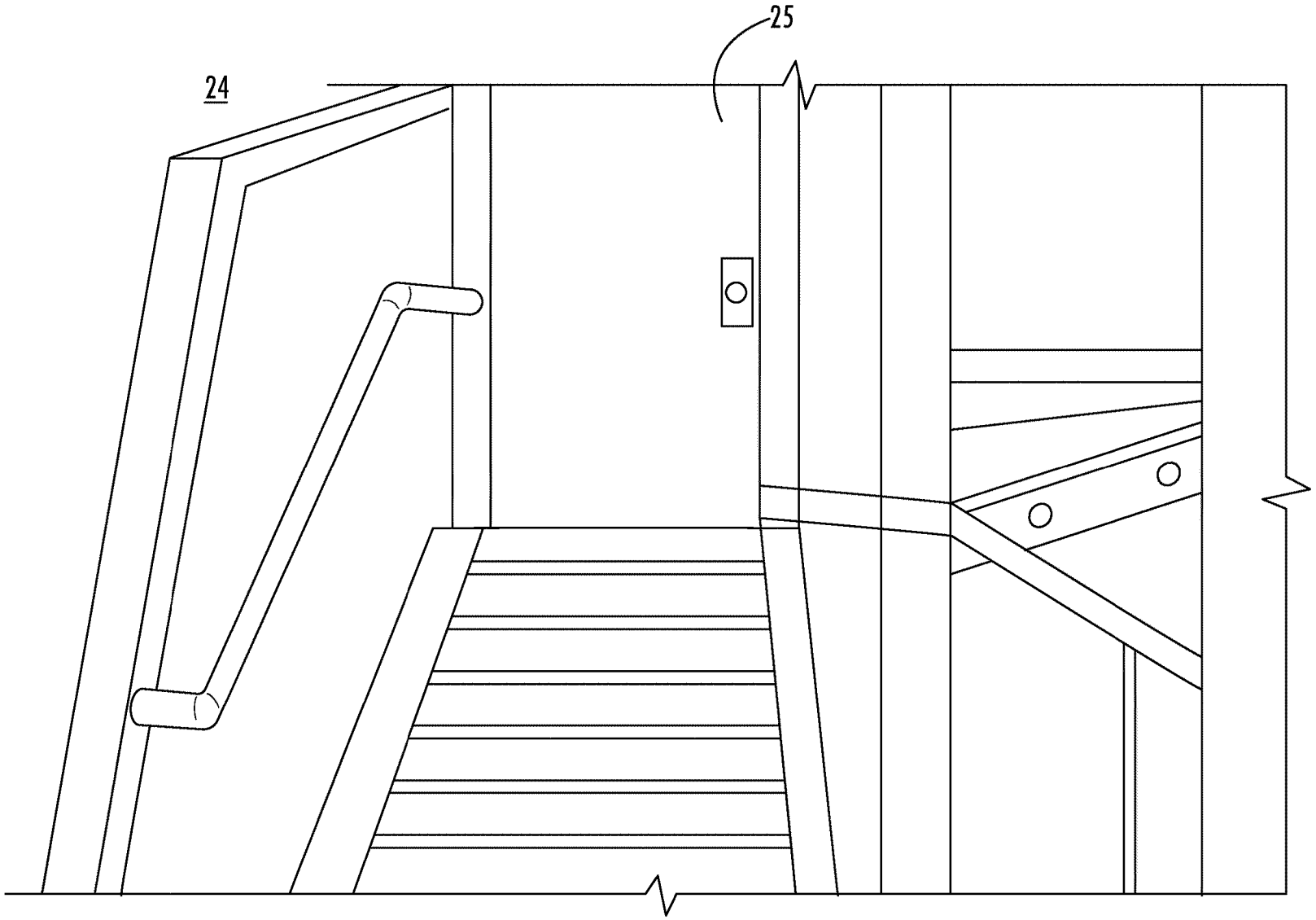
FIG. 6 is a partial front view of the door entry way and upper staircase of FIG. 6.
Figure 7:
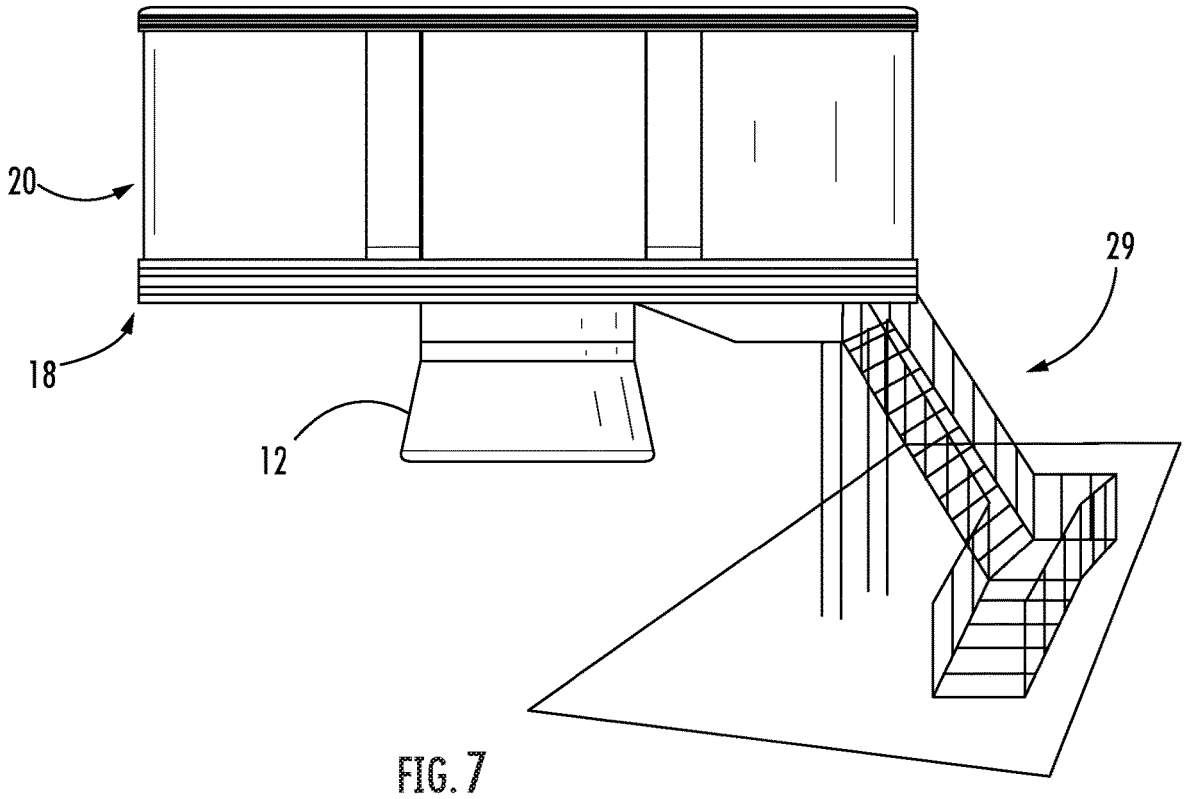
FIG. 7 is a partial right side view of the modular element of FIG. 1, illustrating a staircase attached to the entry enclosure.
Figure 8:
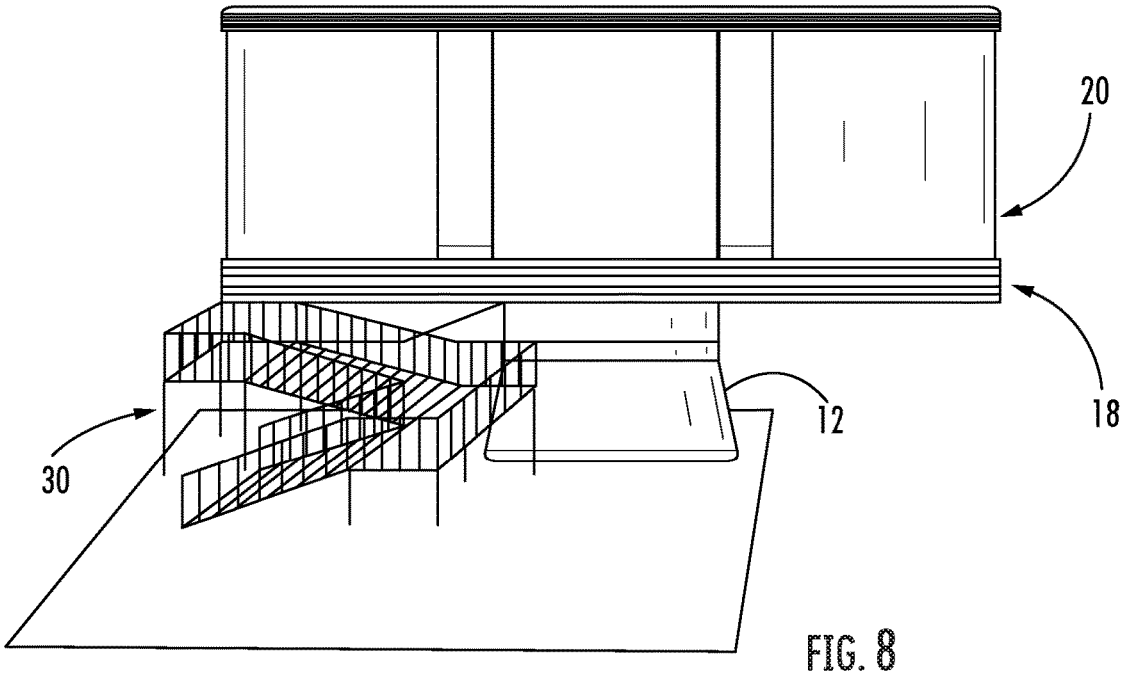
FIG. 8 is a partial left side view of the modular element of FIG. 1, illustrating a different staircase attached to the entry enclosure.

Referring to FIGS. 4 and 5, an entry enclosure 24 is illustrated attached to the underside of floor 18. Entry enclosure 24 includes an outer door 25, illustrated in FIG. 6, which opens into a ramp 26 that gradually ascends through the floor area 18 into the living area in modular element 10. An external stairway 29 (illustrated in FIG. 7) or external stairway 30 (illustrated in FIG. 8) provide access to outer door 25 from the ground level. Alternatively, a small one or two person elevator 32 could be attached to entry enclosure 24, or any other selected area of floor 18 (i.e. entry enclosure 24 could be eliminated entirely).

Figure 9:
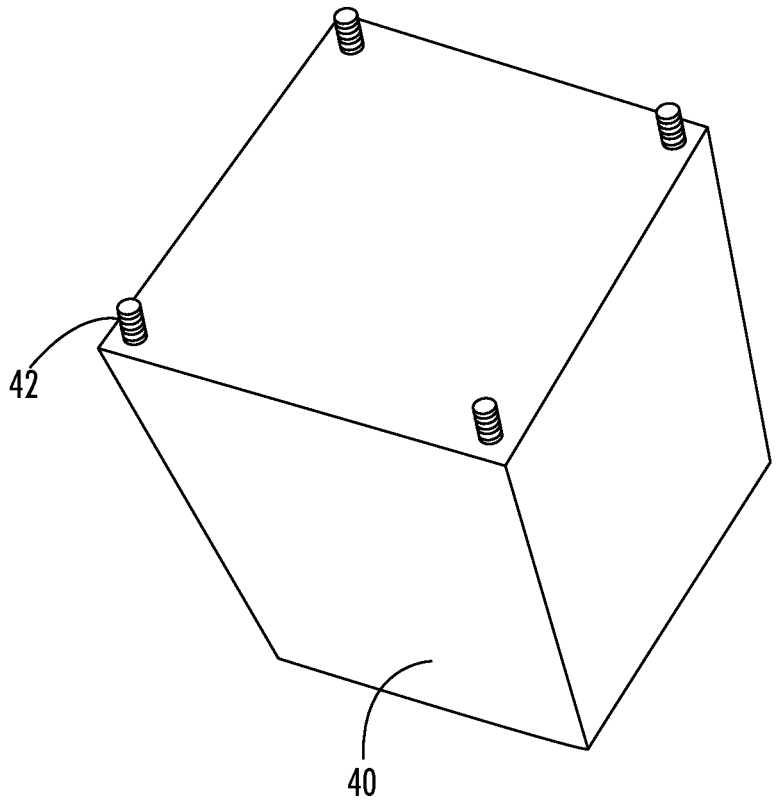
FIG. 9 is a perspective top view of a support pad sunk in the ground.

For a better understanding of the construction of modular element 10, an initial step is illustrated in FIG. 9. A concrete pad 40 is positioned in the ground with the upper surface approximately level with the surrounding ground level. Concrete pad 40 is a base and stabilizer for modular element 10 and is specifically designed to support and hold modular element 10 in a stable upright position. While the size of concrete pad 40 will depend ultimately on the size of modular element 10, in the example illustrated, concrete pad 40 is generally box-shaped (square cross-section) and is eleven feet deep from ground level to the bottom surface. Concrete pad 40 can be positioned or installed in the ground generally by excavating a hole and filling it with concrete. Four threaded studs 42 are positioned in an upwardly extending orientation, one each, at each corner of concrete pad 40.

Figure 10:
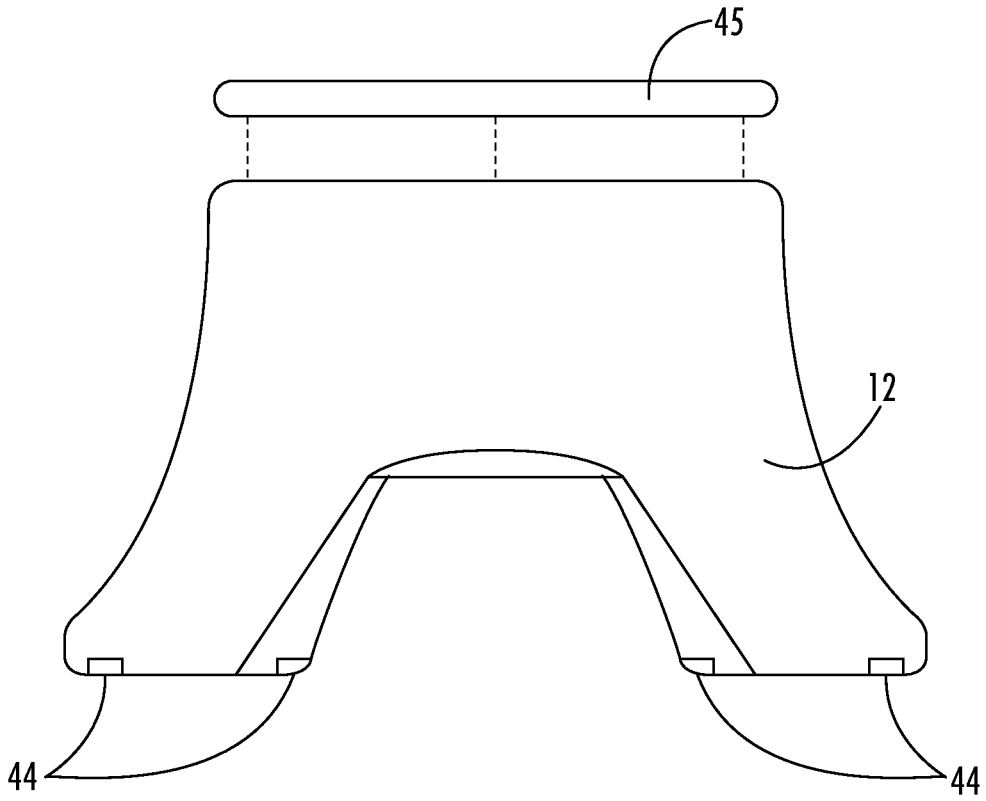
FIG. 10 is a side view of a base, attached to the support pad of FIG. 9, for the single modular element of FIG. 1.

Referring to FIG. 10, base support 12 is illustrated with four attachment wells 44, one each, in each of the corners. Each attachment well 44 includes a lock nut that mates with one of the threaded studs 42 on concrete pad 40 to hold base support 12 fixedly attached to concrete pad 40. It will be understood that base support 12 can be formed of any material sufficiently rigid and strong (e.g. metal, plastic, concrete preform, etc.) to support the remaining portions of modular element 10. A friction seal 45 (may be for example a silicon spray) is affixed to the upper surface of base support 12.

Figure 11:
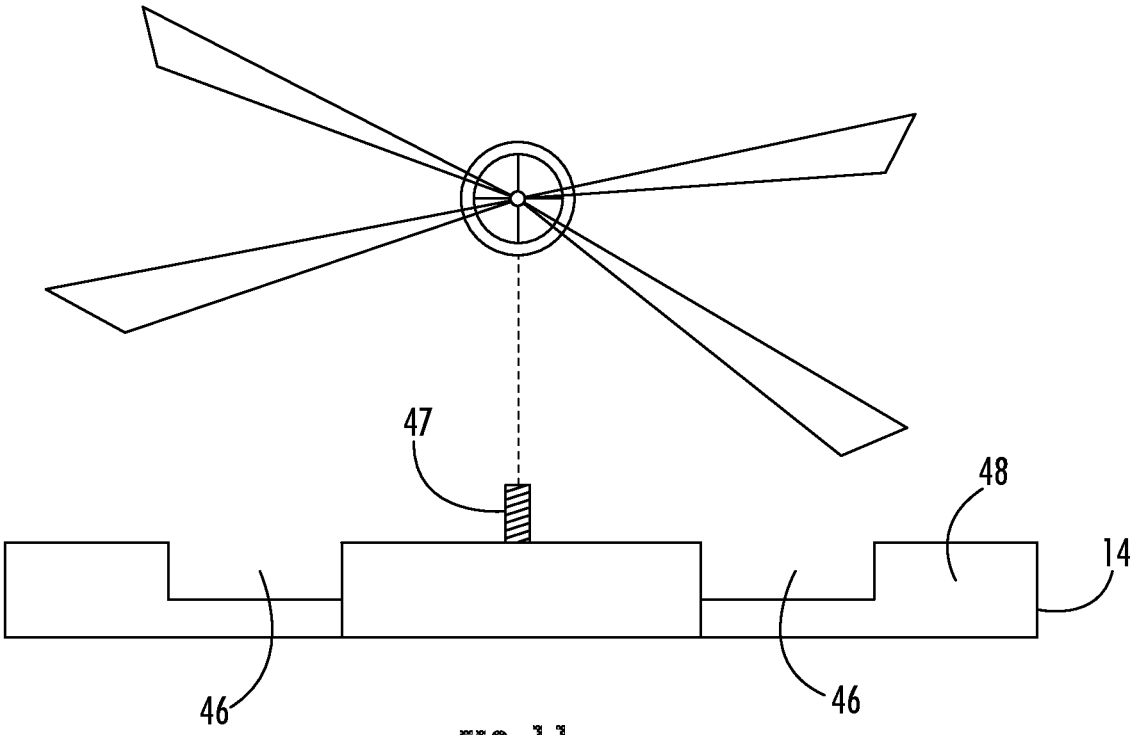
FIG. 11 is a side view of an anchor collar that fits on the upper end of the base illustrated in FIG. 10.

Turning to FIG. 11, anchor collar 14 is illustrated in detail. Anchor collar 14 is designed to mate with the upper end or surface of base support 12 and is sealed in position by friction seal 45. In this specific embodiment, base support 12 has a generally rectangular cross-section at the bottom where it mates with concrete pad 40 and it tapers upwardly into a smaller generally rectangular cross-section at the upper end, where it mates with anchor collar 14. Anchor collar 14 has a generally rectangular cross-section that mates with the upper end of base support 12 and four grooves 46 spaced apart with one groove in each side of rectangularly shaped anchor collar 14. While four grooves are described in this example it will be understood that more or less could be used in different applications. For example, the upper end of base support 12 could be round or oval shaped and anchor collar 14 could have a mating round or oval shape.

In this specific example, anchor collar 14 has a rectangular-shaped base with an upwardly directed wall 48 extending around the periphery to define a depression 49 in the center. Grooves 46 are cut into wall 48 down to the surface of central depression 49 so that the bottoms of grooves 46 are in a common plane with the bottom of depression 49. Also, anchor collar 14 has a support rod affixing element, which in this example is a threaded stud 47 (preferred because of its simplicity) fixedly mounted at the center of depression 49 in an upwardly directed orientation. It will be understood that while the upper end of base support 12 and anchor collar 14 are rectangular in shape in this specific embodiment any other desired shape (e.g. round, oval, square, even irregular, etc.) could be used for specific applications.

Figure 12:
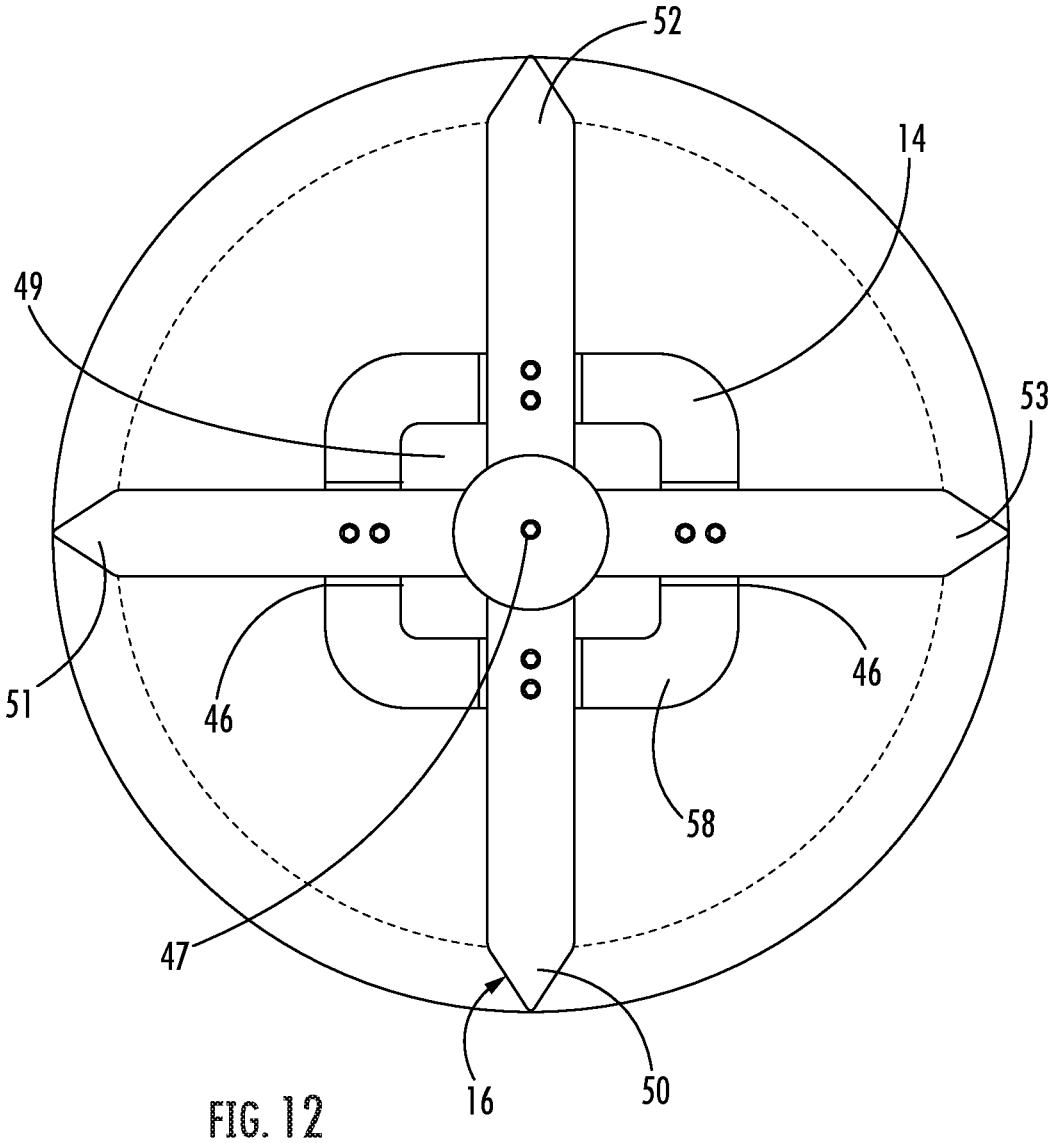
FIG. 12 is a top view of support beams fitted into the anchor collar of FIG. 11.
Figure 13:
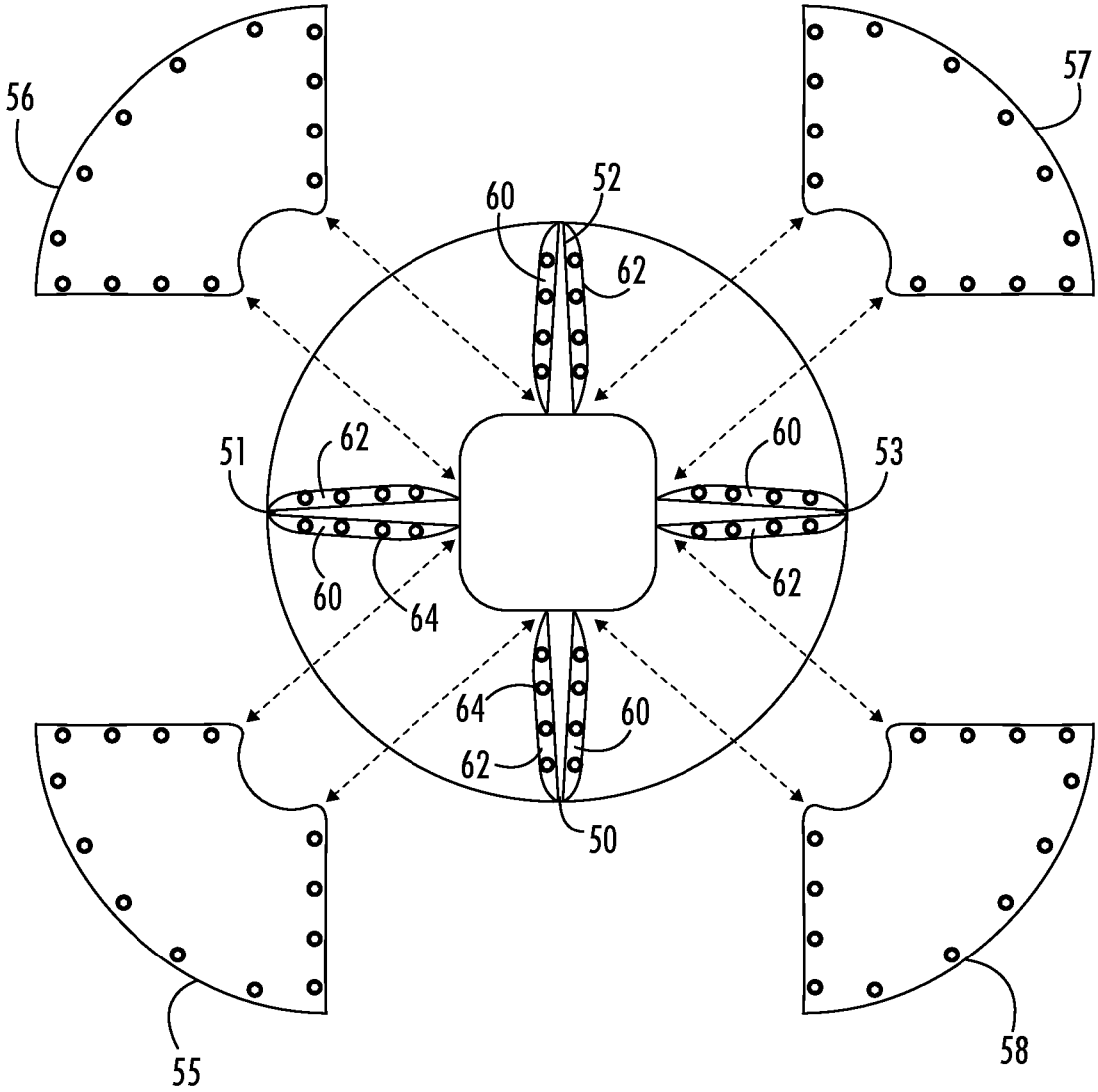
FIG. 13 is a top view of floor section placement on the support beams FIG. 12.
Figure 14:
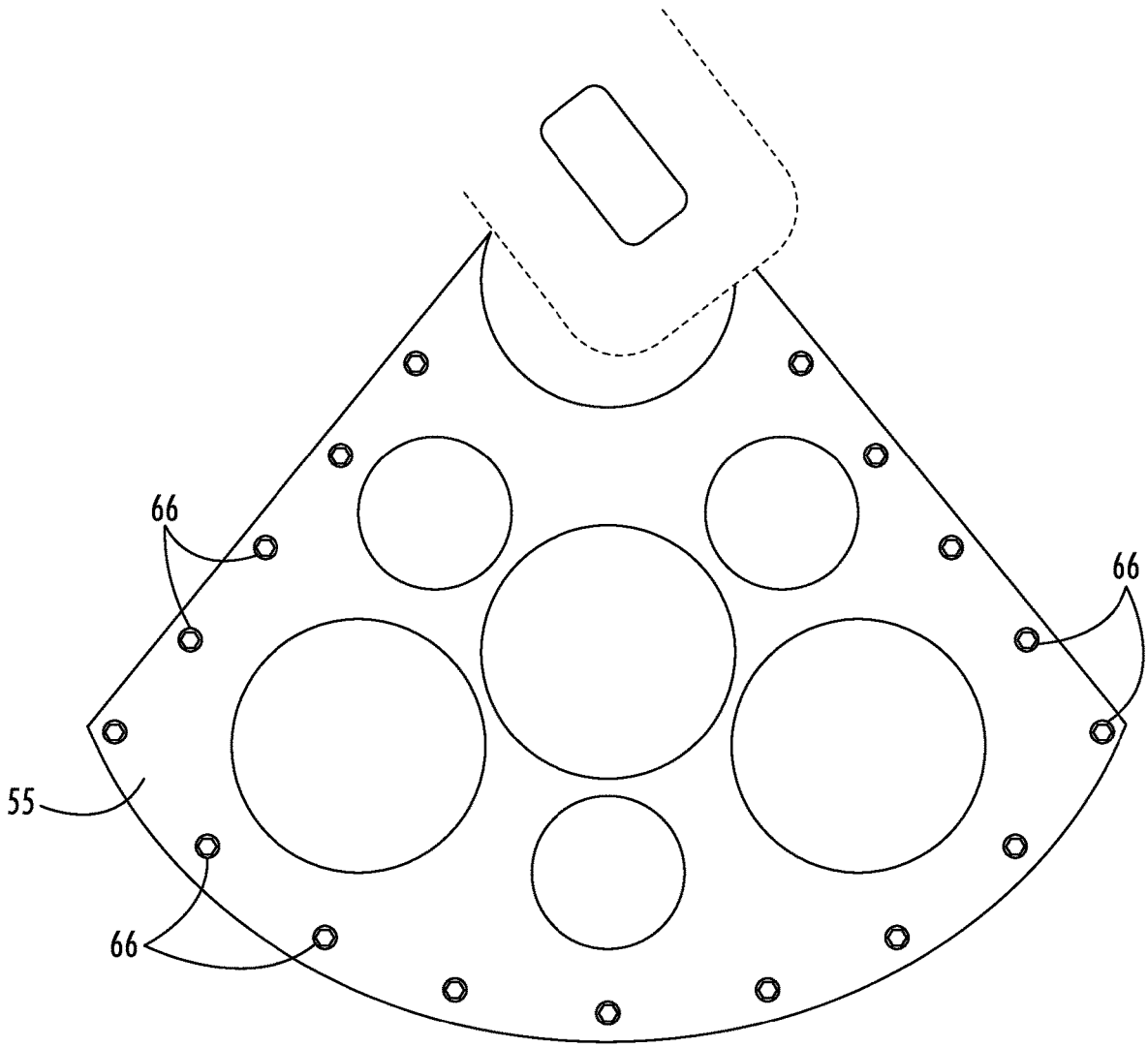
FIG. 14 is a top view of a floor section of FIG. 13.

Referring specifically to FIG. 12, quad beam 16 is illustrated positioned in grooves 46 in anchor collar 14 with the centrally located threaded stud 47 extending upwardly through a central hole in quad beam 16. Quad beam 16 has four arms 50-53 that extend radially outwardly to the outer extremity of floor 18 and walls 20 (shown in broken lines in FIG. 12). With quad beam 16 in place, four floor sections or panels 55-58 (see additionally FIGS. 13 and 14) are positioned between the four arms 50-53 of quad beam 16, floor section 55 between arms 50 and 51, floor section 56 between arms 51 and 52, floor section 57 between arms 52 and 53, and floor section 58 between arms 53 and 50. Each of the four arms 50-53 has a flange 60 extending the length thereof on one side and a flange 62 extending the length thereof on the other side. Flanges 60 and 62 include pre-drilled bolt holes 64 which mate with pre-drilled bolt holes 66 along the peripheries of floor sections or panels 55-58. Thus, to hold floor sections or panels 55-58 in place, bolts are inserted through holes 66 in floor sections or panels 55-58 and down through holes 64 in the four arms 50-53. The bolts are then secured by nuts or the like to fixedly hold floor sections or panels 55-58 in place. The combined floor sections or panels 55-58 form a floor or floor disc for modular element 10 with the outer edges of the floor disc defining the outer extremities of modular element 10.

Figure 15:
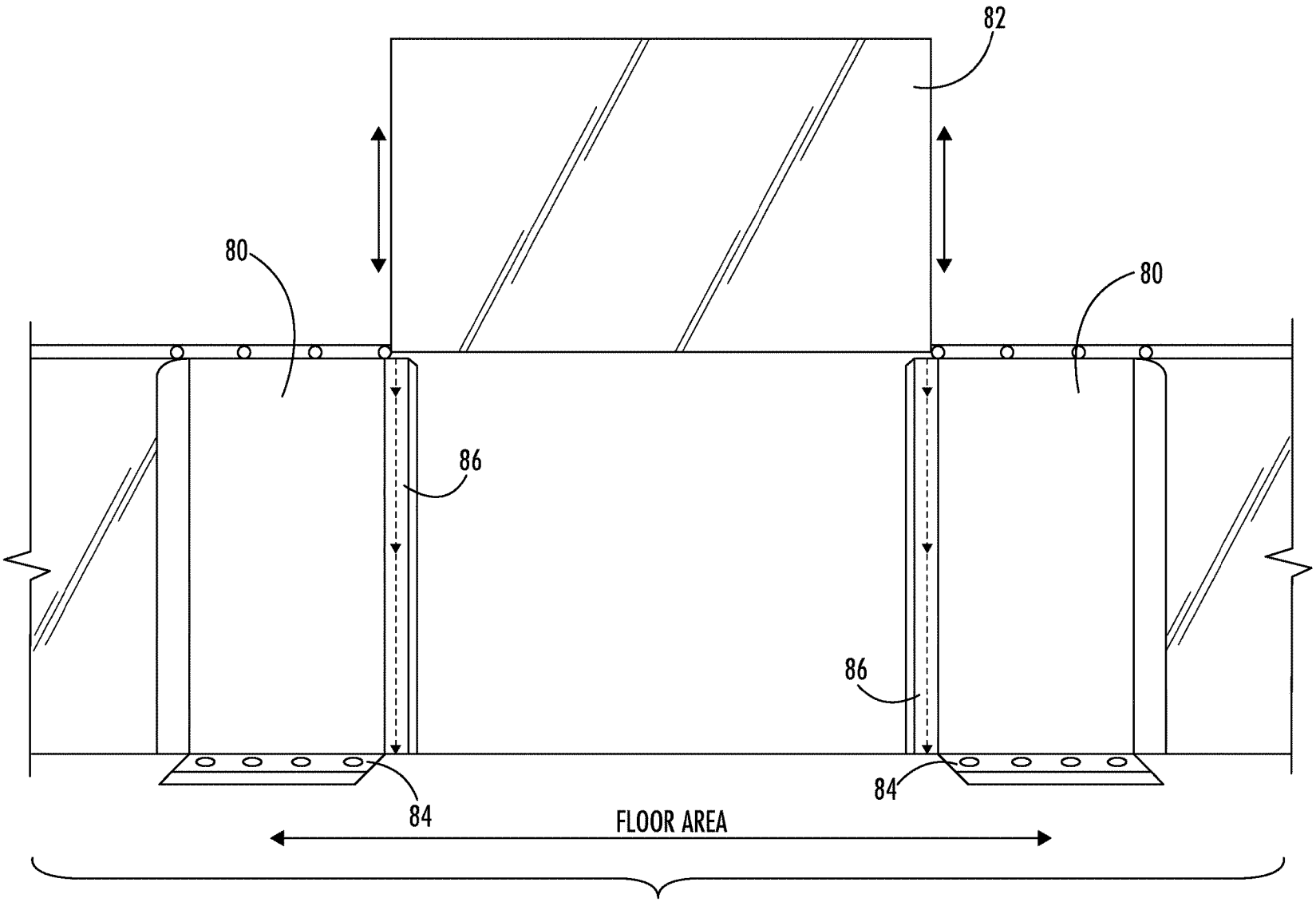
FIG. 15 is a partial side view of illustrating window and panel placement in conjunction with FIG. 16.
Figure 18:
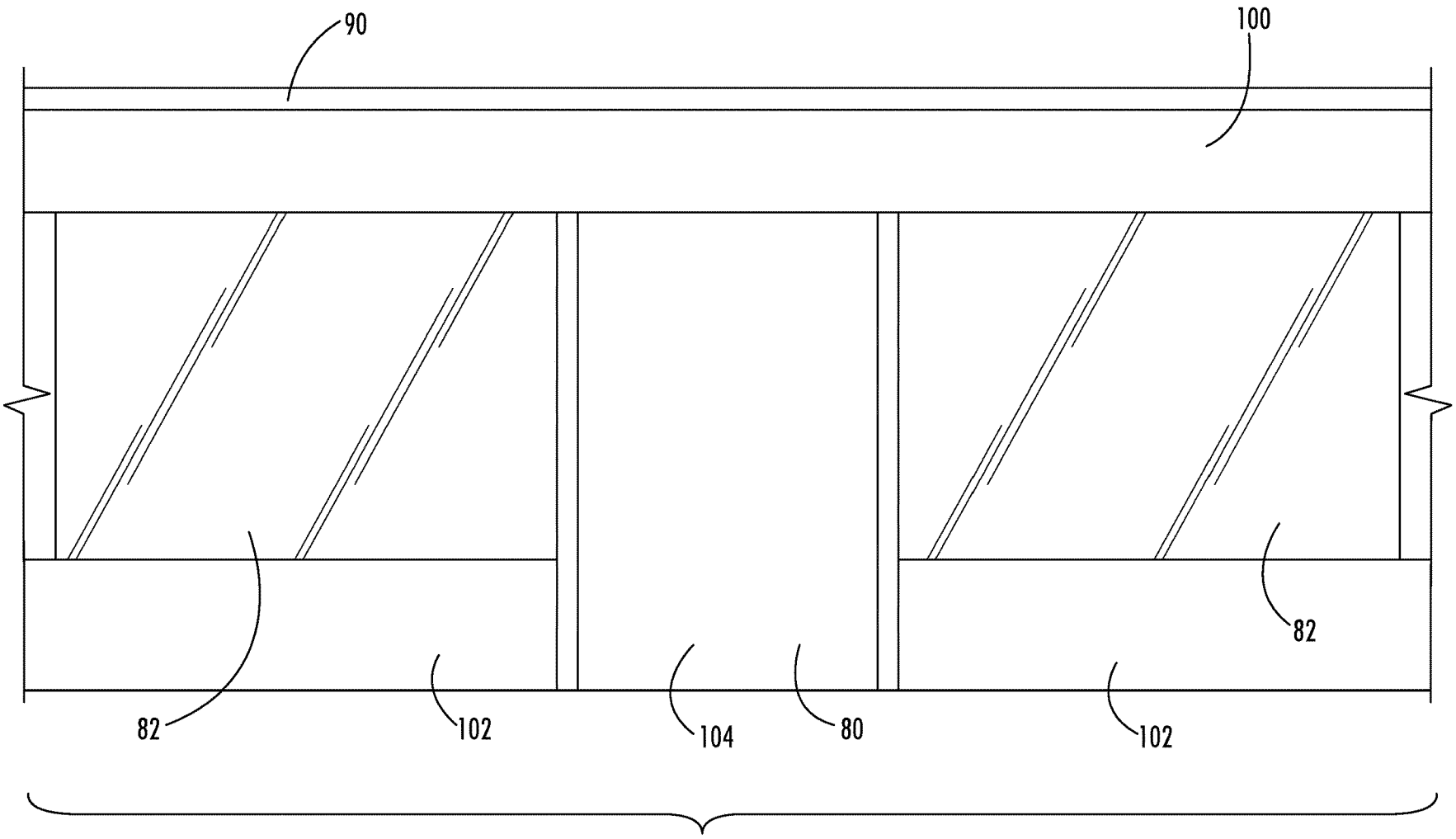
FIG. 18 is a partial side view of insulation placement in conjunction with the window placement of FIG. 16.

Turning to FIG. 15, a partial side view is illustrated showing the placement of panels 80 and windows 82. Panels 80 are rectangular sections of wall having mounting flanges 84 extending horizontally outward along a lower edge. Flanges 84 are constructed to mate with holes 66 in floor sections 55 adjacent the outer arcuate edge (see FIG. 14) and are bolted to floor sections 55 in an upright orientation. Referring additionally to FIG. 18, it can be seen that in this specific embodiment eight panels 80 are equally spaced around and defining wall 20. Panels 80 are relatively small sections, horizontally (width), with channeled edges 86 on each opposite vertical edge. Panels 80 are provided primarily to form a support for windows 82 and may be any desired width that will fit into and fill out wall 20.

Windows 82 can be simply slid into an opposed pair of channeled edges 86 of adjacent panels 80, from the top as illustrated in FIG. 15. Windows 82 are friction sealed in channeled edges 86 or a silicon spray may be used to make the structure air tight. In the present embodiment, windows 82 will be slightly arcuate horizontally since wall 20 of modular element 10 is round. However, it will be understood by the artisan that flat windows could be used if desired with each window 82 forming a small corner or angle with each adjoining panel 80.

Figure 16:
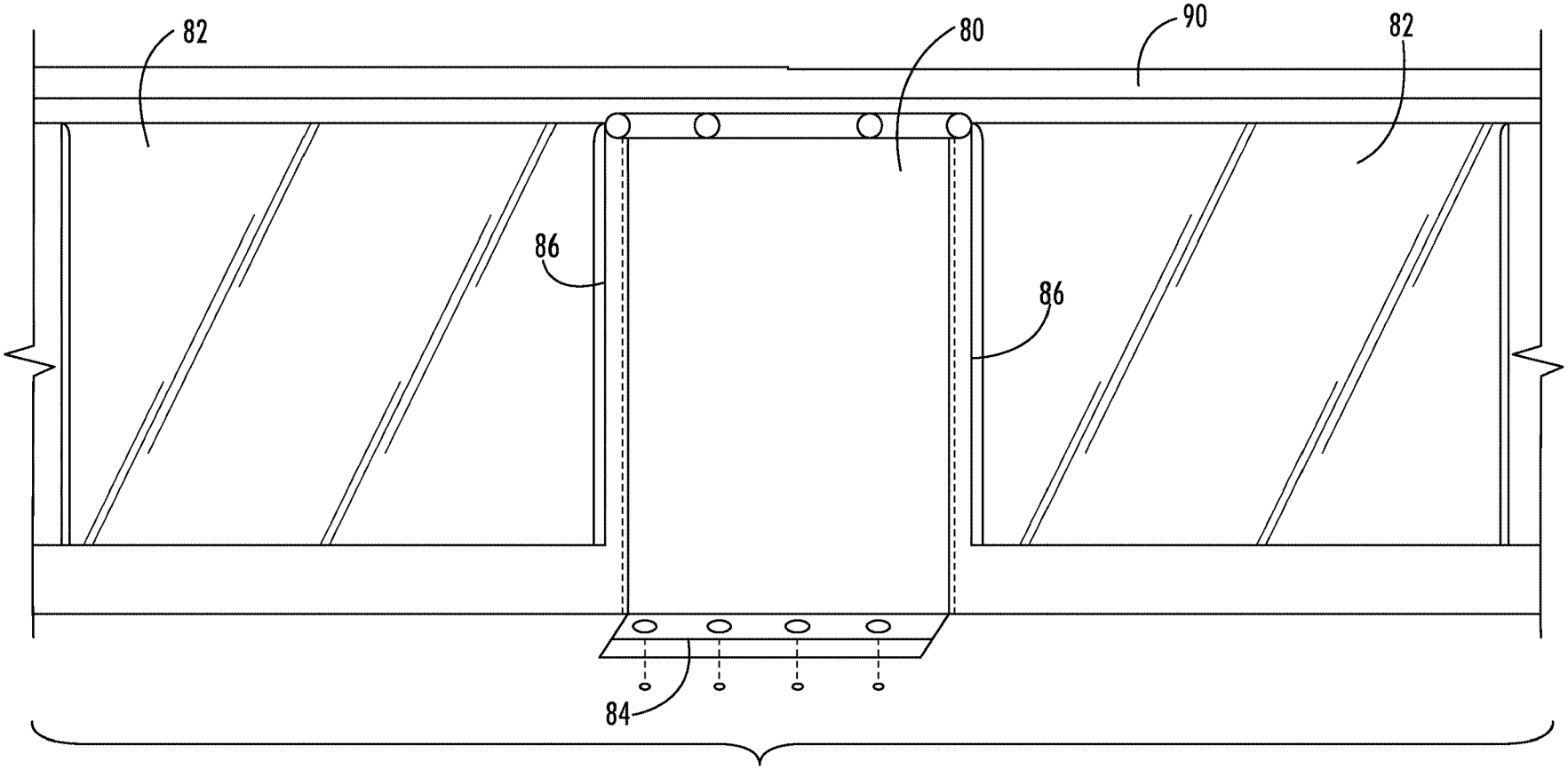
FIG. 16 is a partial side view of a panel flange attached to the floor area and window placement.
Figure 17:
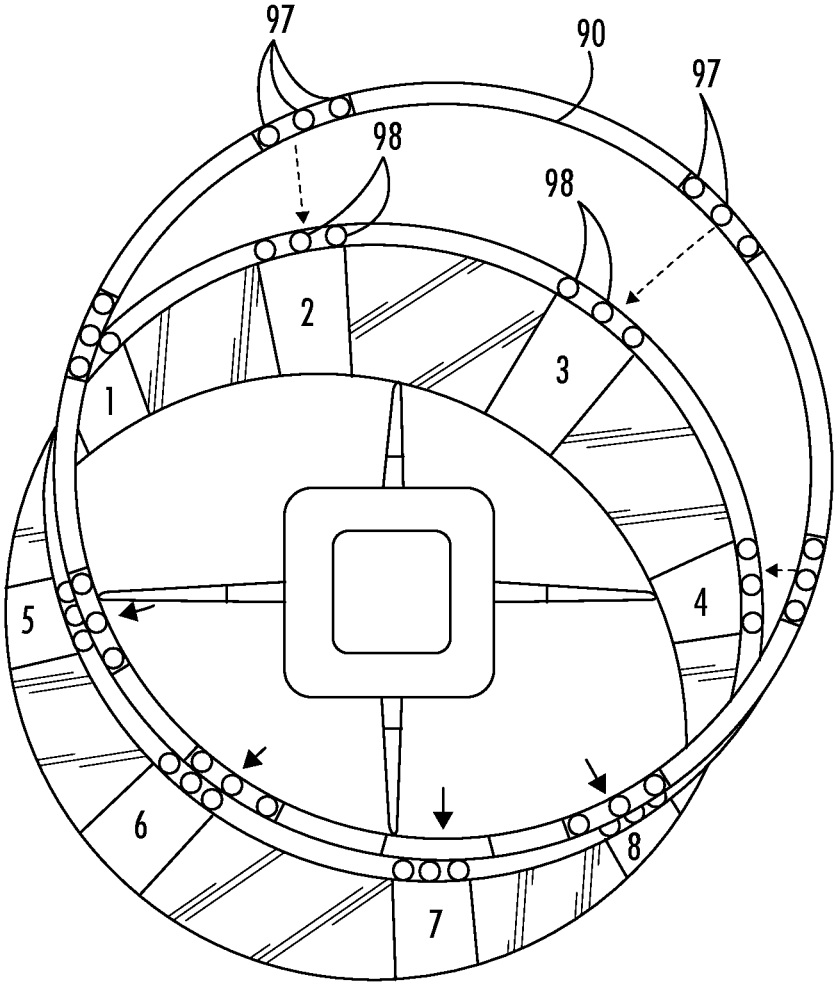
FIG. 17 is a perspective top view of the structure after window, panel and insulation placement, illustrating the retainer ring assembly.
Figure 22A:
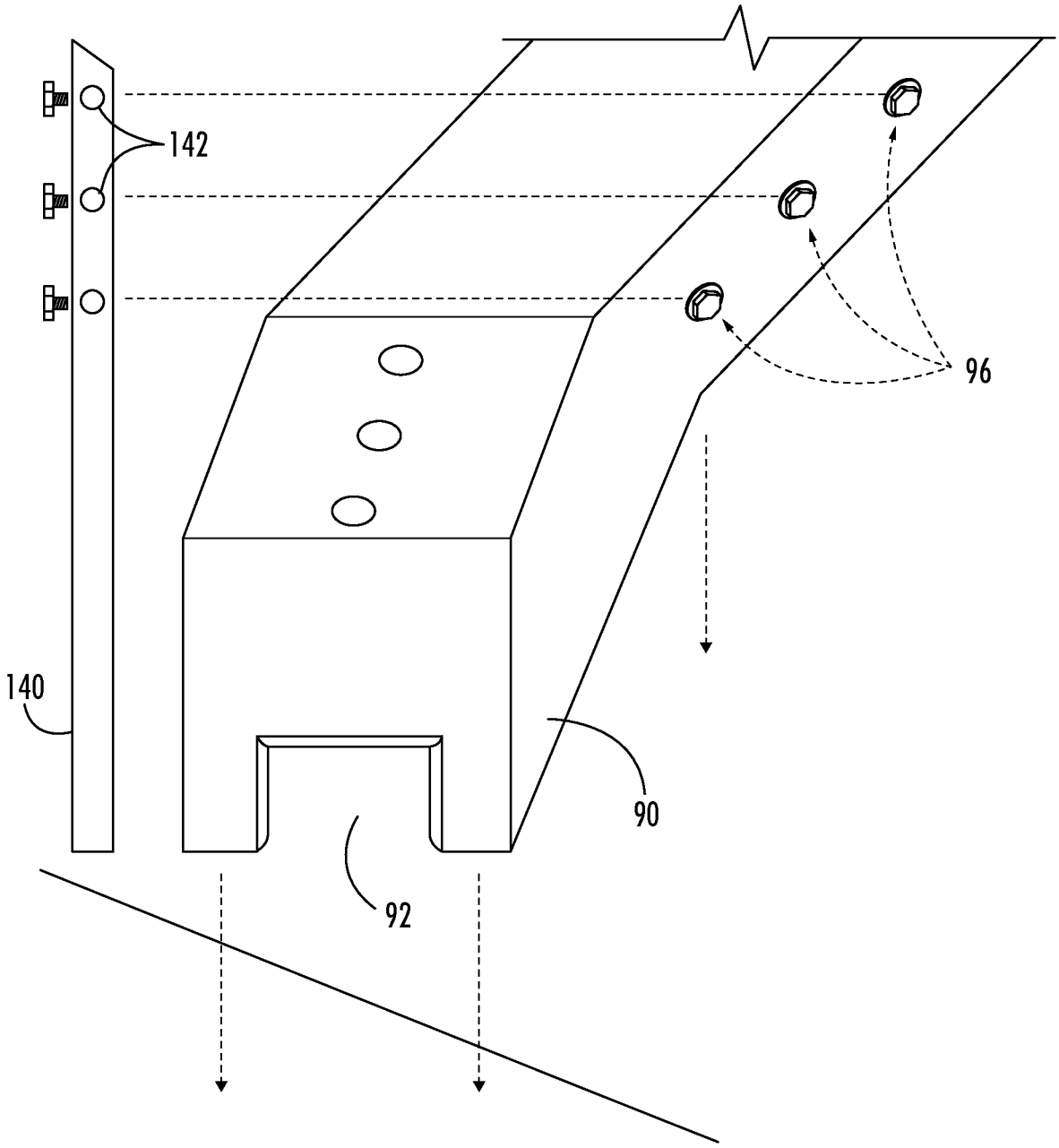
FIGS. 22A and 22B are partial side perspective views, a portion above the window panes and a portion above the wall panels, respectively, of the retainer ring illustrated in FIG. 18.
Figure 22B:
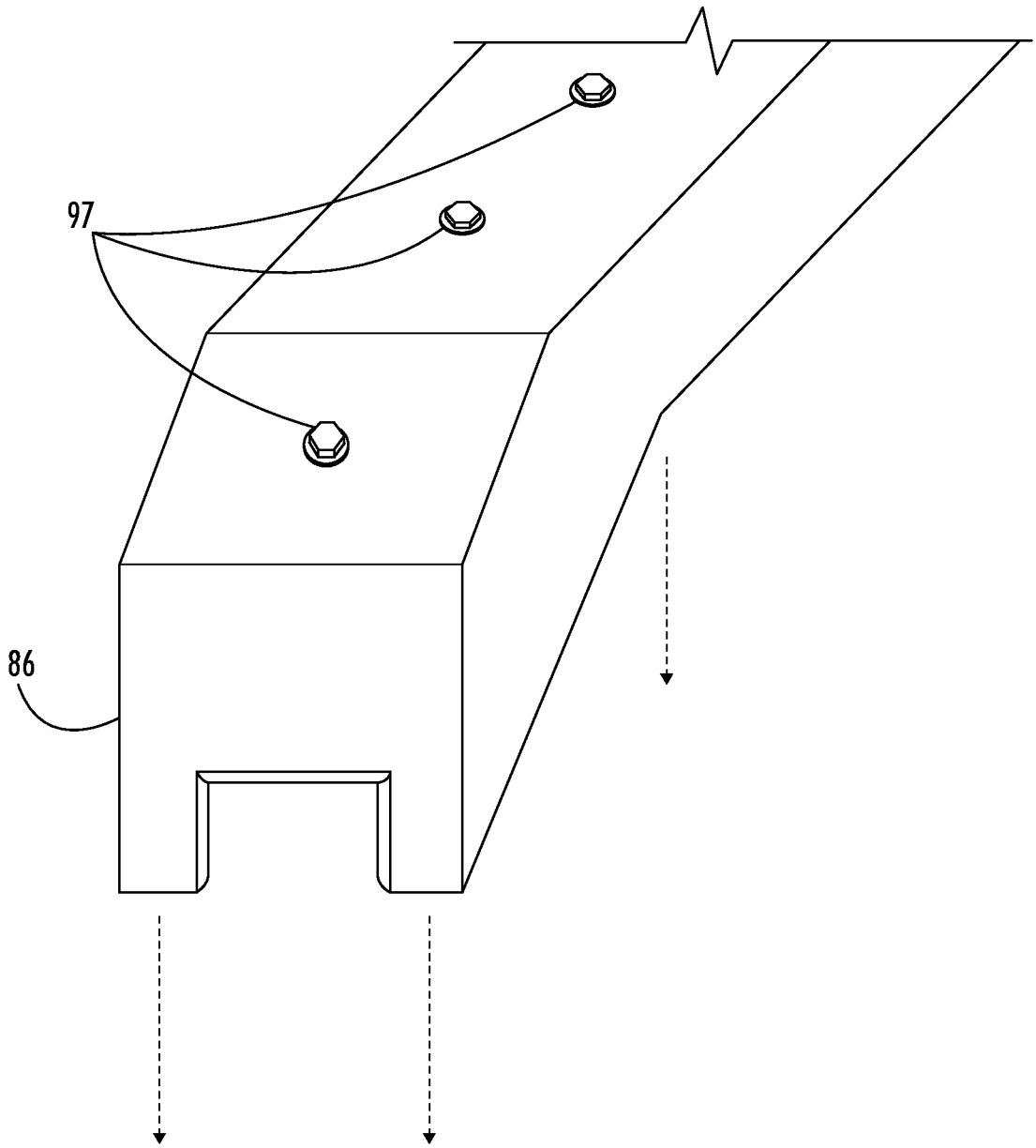

With panels 80 and windows 82 installed, a retaining ring 90 is fixedly engaged over the upper edge of the structure, as illustrated in FIGS. 16 and 17. Retaining ring 90 is illustrated in more detail in FIGS. 22A and 22B. Referring specifically to FIG. 22A, retaining ring 90 has a downwardly opening groove 92 that engages with the upper edges of panels 80 and windows 82 to hold the entire structure fixedly and rigidly in place. Retaining ring 90 also has bolt holes 96 formed therethrough to mate with bolt holes 142 through roof flange 140 mount roof 22. The portions of retaining ring 90 positioned above panels 80 have a flat upper surface, as illustrated in FIG. 22B, with bolt holes 97 formed therethrough and positioned to mate with bolt holes 98 in the top surfaces of panels 80. Thus, with retaining ring 90 engaged over the upper edge of the structure, bolts are inserted through holes 97 in retaining ring 90 and threaded into holes 98 in panels 80 to hold retaining ring 90 fixedly in place.

Figure 19:
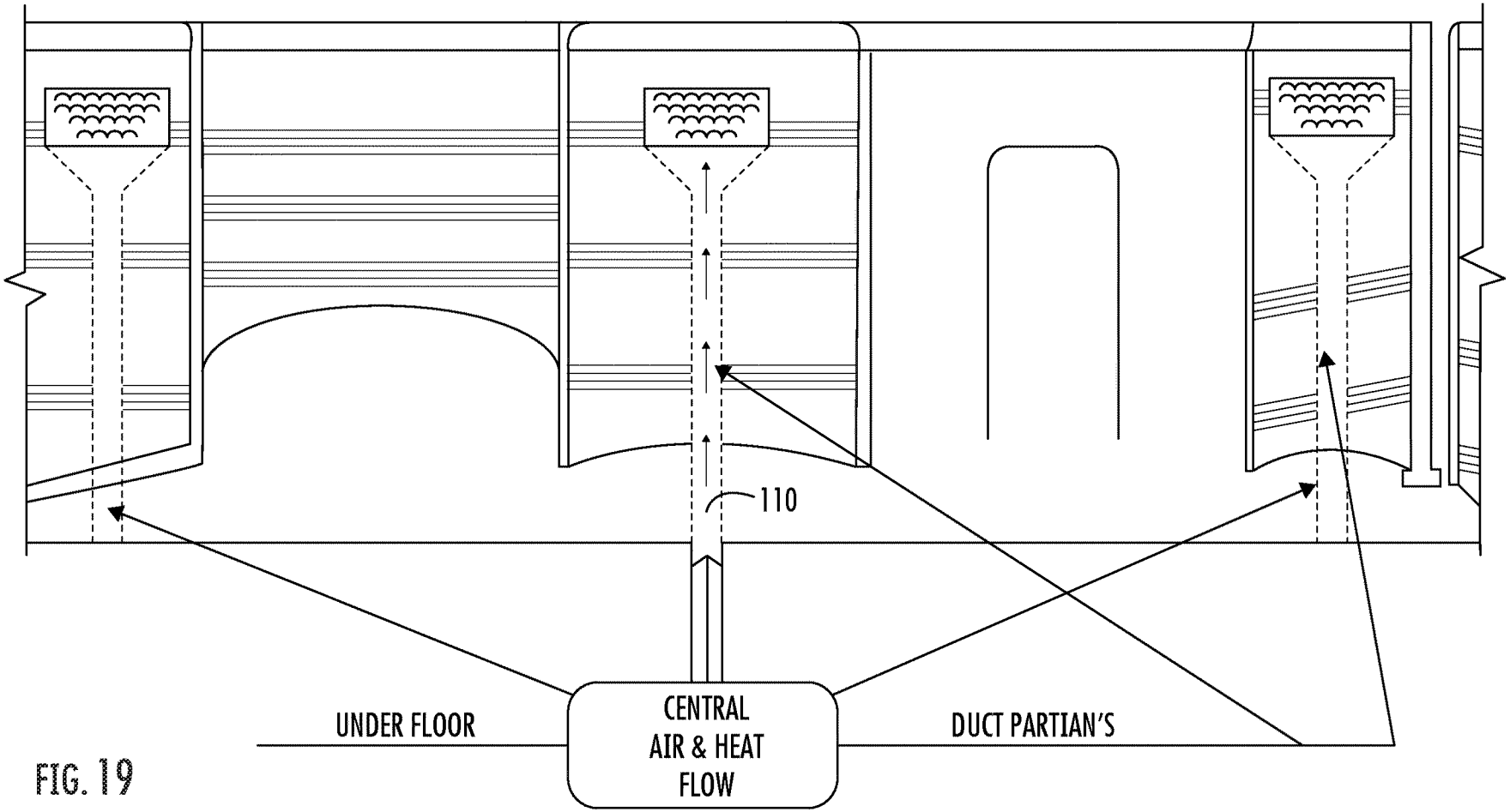
FIG. 19 is a partial side view of illustrating central air and heating ducts.

Referring additionally to FIG. 18, insulation placement, in conjunction with the window placement illustrated in FIG. 16 is shown. An upper section of insulation 100 covers any gaps that might be prevalent between the panels 80, windows 82 and the exterior. A lower section 102 covers the area between windows 82 and floor sections 55. Insulation section can also cover the area between panels 80 and floor sections 55 or separate insulation sections 104 may cover panels 80. Referring additionally to FIG. 19, central air and heating ducts can be included internally in panels 80 and under floor sections 55 to an air and heat unit positioned below floor 18 or within base support 12.

Figure 20:
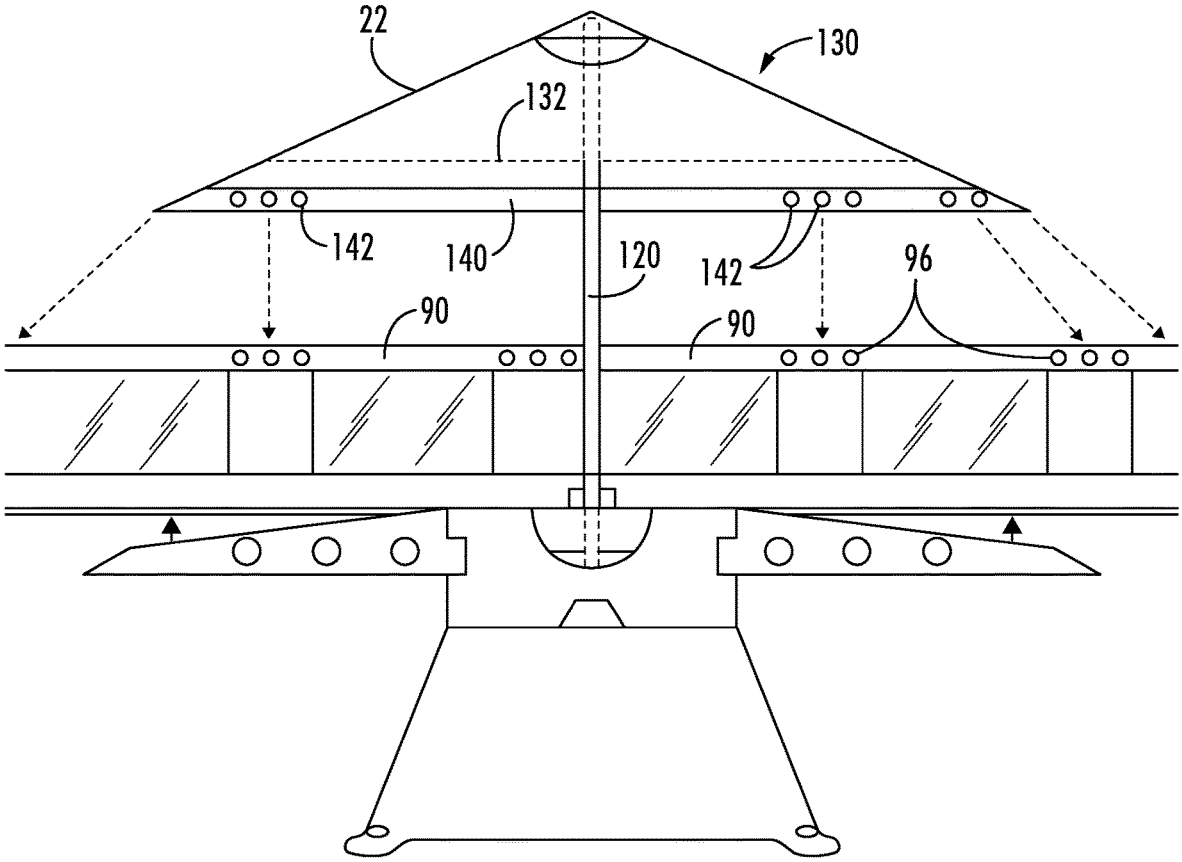
FIG. 20 is a partial side view illustrating the roof and roof support assembly on the structure of FIGS. 17 and 18.
Figure 21:
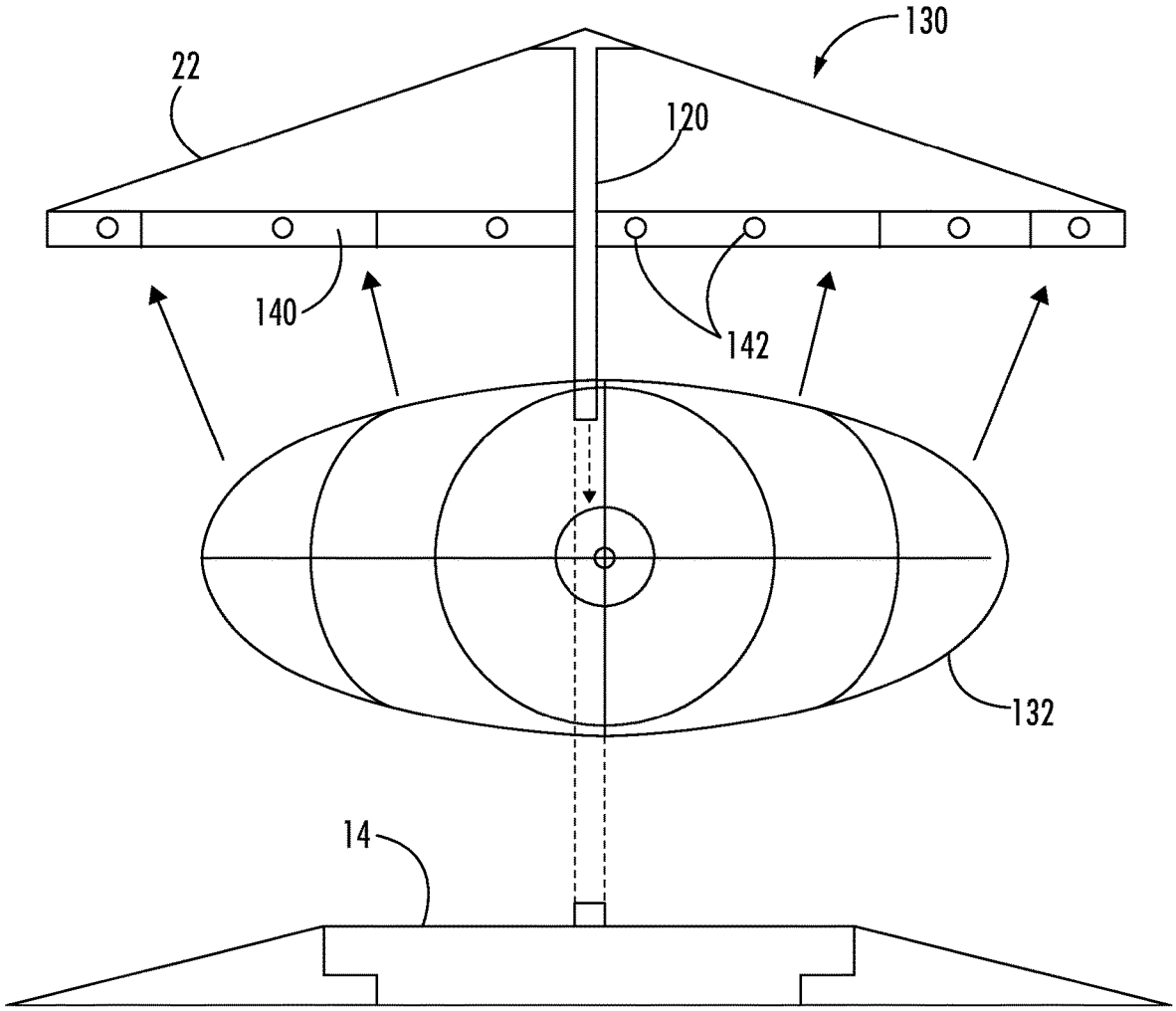
FIG. 21 is another partial side view illustrating an alternate roof and roof support assembly on the structure of FIGS. 17 and 18.

At some time during the construction and assembly, a roof support structure is installed, in this specific example a roof support rod 120 (see FIG. 20) is installed. Roof support rod 120 has an internally threaded lower end and is installed by threadedly engaging the lower end with threaded stud 47 (see FIGS. 11 and 12). Once roof support rod 120 is threaded onto stud 47, quad beam 16 is held fixedly in place. Roof support rod 120 extends vertically upward beyond the upper edge of retaining ring 90 and a roof assembly 130 is engaged over the upper end. Roof assembly 130 includes roof 22, in this embodiment slanted at approximately 33 degrees, a grid 132 (see FIG. 21) essentially forming a ceiling for the living space in modular element 10 and defining an attic under roof 22, and a flange 140 extending vertically downwardly around the lower periphery of roof assembly 130. Flange 140 has bolt holes 142 formed horizontally therethrough and positioned to mate with bolt holes 96 formed through flange 94 on retaining ring 90. With roof assembly 130 in position, bolts are extended through holes 142 and 96 and terminated to fixedly lock roof assembly 130 in position over wall 20. Grid 132 is designed with openings to allow lights and other accessories to be hung therefrom.

Figure 23:
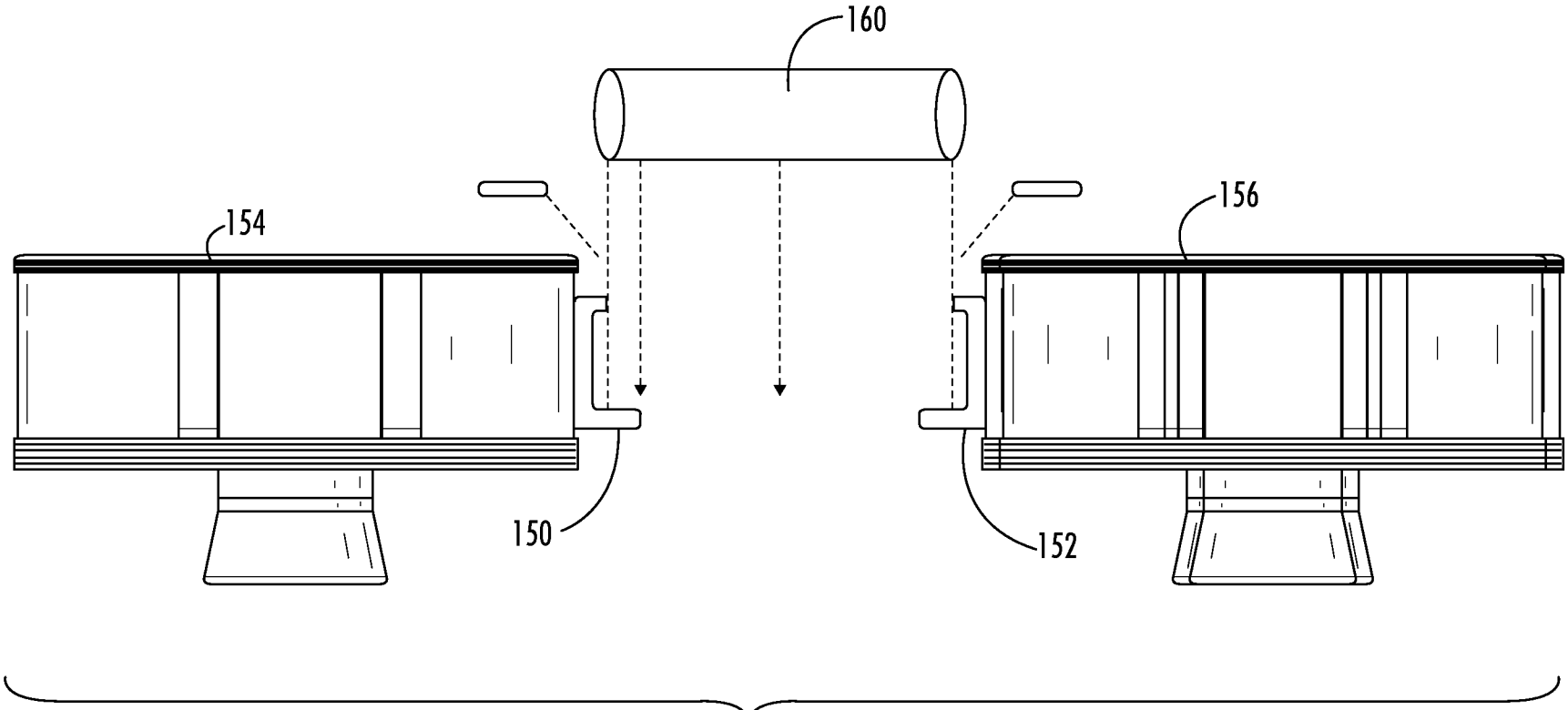
FIG. 23 is a cut-away view of walkway placement between adjacent modular elements similar to FIG. 1.
Figure 24:
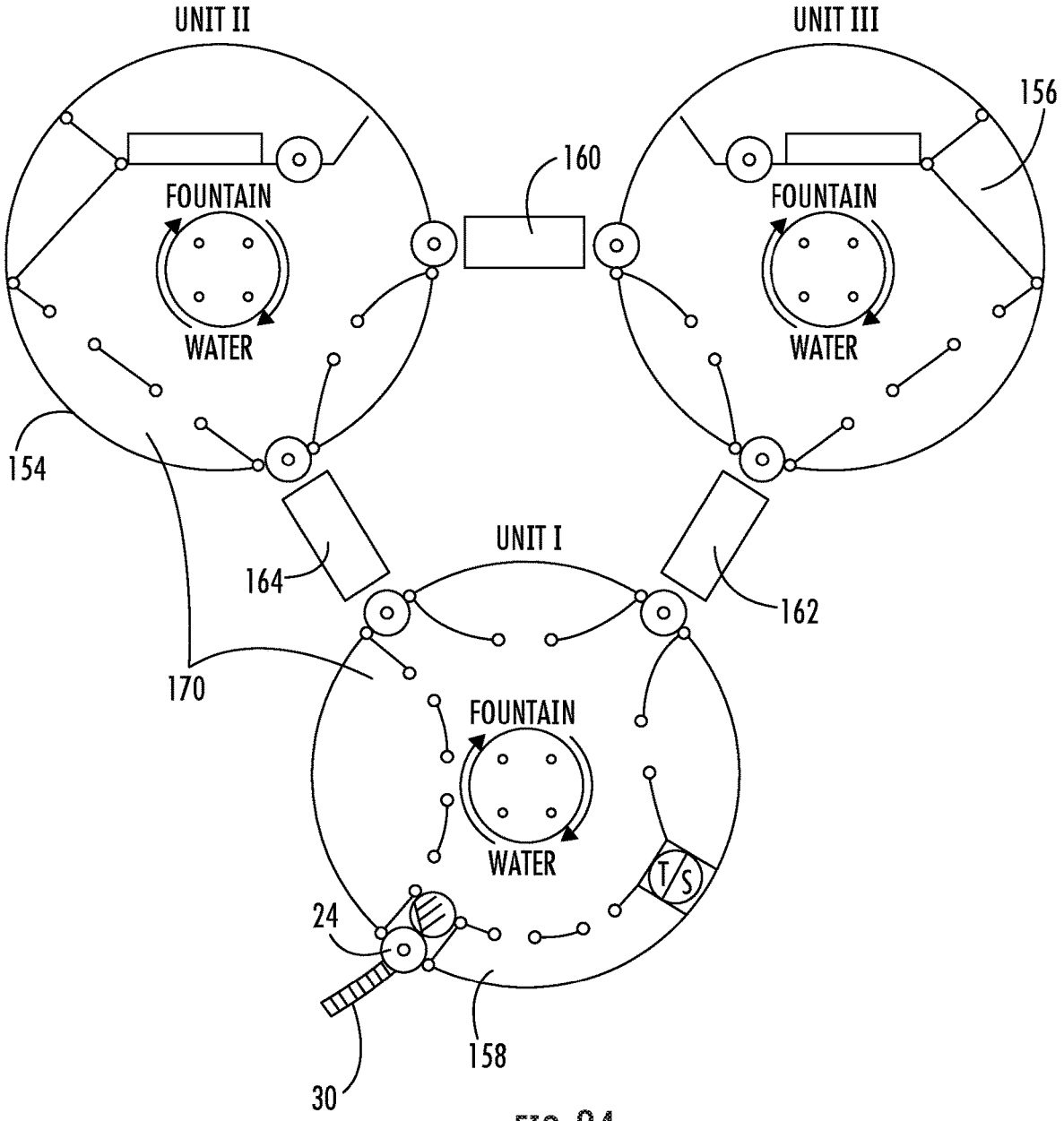
FIG. 24 is a top plan view of completely assembled three modular elements with potential living space uses.

Thus, modular element 10, is assembled and completely sealed in accordance with the present invention. It will be understood that modular element 10 is a complete unit and can be used as assembled above. In addition, modular element 10 can be coupled to other similar units to form larger buildings. For example, as illustrated in FIG. 23, collar attachments 150 and 152 can be inserted in walls 20 at selected areas of adjacent modular elements 154 and 156 and a walkway 160, in this example tubular, is fixed at one end in collar attachment 150 and at the other end in collar attachment 152. For example, collar attachments 150 and 152 could replace an entire panel 80 or could be set into a panel 80 with the inner portion forming a doorway from walkway 160 into the particular selected areas of modular elements 154 and 156. Referring additionally to FIG. 24, another modular element 158 can be added in a generally triangularly shaped arrangement and walkways 162 and 164 can be installed between modular elements 156 and 158 and between modular elements 154 and 158, respectively. An entry enclosure 24 and an external stairway 30 can be added to one or more of the modular elements 154, 156 and 158 or alternatively or additionally an elevator 32 can be provided. Internal room dividers can be added to divide each or any of the modular elements 154, 156 and 158 into rooms such bedrooms, a living room, a dining room, lounge, etc. While three modular elements 154, 156 and 158 are combined in this example in a generally triangular shape, it will be understood that more or less elements may be combined into other configurations, e.g. a square, straight or wavy line, etc.

Thus, a new and improved modular unit or element is disclosed that can operate alone as a modular building or can be combined with other similar modular units or elements to form a more extensive modular building. The modular units or elements are attractive and practical and can be decorated to form any desired room or area. Also, because the modular units or elements are above ground they are easier to protect against break-ins, small natural occurrences, etc. and they provide, in most instances, a superior view of the outside area.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A modular unit or element comprising:

a concrete pad having an upper surface;

a base support affixed to the upper surface of the concrete pad;

an anchor collar affixed to the base support, the anchor collar defining spaced apart grooves;

a multi-arm beam positioned in the anchor collar with one arm of the multi-arms positioned in each of the spaced apart grooves so as to extend radially outwardly from the anchor collar;

a plurality of floor sections affixed to the multi-arm beam, one each floor section of the plurality of floor sections affixed between adjacent arms of the multi-arm beam to form a floor disc for the modular unit or element, the floor disc defining an outer periphery of the modular unit or element;

a plurality of wall panels affixed to outer portions of the floor disc, the plurality of wall panels being spaced apart around the outer periphery of the floor disc and oriented in an upwardly directed position to define a peripheral wall around the floor disc, each wall panel of the plurality of wall panels having channeled edges on each opposite vertical edge;

a plurality of window inserts, one each engaged in opposed channeled edges of adjacent wall panels;

a retaining ring extending around the peripheral wall, the retaining ring having a downwardly opening groove engaged with an upper edge of each window insert and fixedly attached to an upper edge of each of the plurality of wall panels; and a roof and roof support structure affixed to the roof, the roof including a grid defining a ceiling for the modular unit or element.

2. The modular unit or element as claimed in claim 1 wherein the concrete pad is positioned in ground with the upper surface substantially parallel with surrounding ground level or surface.

3. The modular unit or element as claimed in claim 2 wherein the concrete pad includes a plurality of threaded studs embedded in the concrete pad and positioned in an upwardly extending orientation.

4. The modular unit or element as claimed in claim 3 wherein the base support is affixed to the upper surface of the concrete pad by the plurality of threaded studs.

5. The modular unit or element as claimed in claim 1 wherein the anchor collar includes an upwardly directed wall extending around a periphery to define a depression in a center, and the spaced apart grooves are cut into the wall down to a surface of the central depression so that bottoms of the grooves are in a common plane with a bottom of the depression.

6. The modular unit or element as claimed in claim 5 wherein the anchor collar includes a centrally located support rod affixing element fixedly mounted at the center of depression.

7. The modular unit or element as claimed in claim 6 wherein the roof support structure includes an elongated rod having a lower end engaged with the support rod affixing element and an upper end engaged with the roof.

8. The modular unit or element as claimed in claim 1 wherein the anchor collar is affixed to the base support by one of a friction seal and silicon spray.

9. The modular unit or element as claimed in claim 1 wherein the plurality of window inserts engaged in opposed channeled edges of adjacent wall panels are sealed by one of a friction seal and silicon spray.

10. The modular unit or element as claimed in claim 1 wherein the roof is affixed to the retaining ring by an upwardly directed flange extending around an upper surface of the retaining ring and the roof includes a flange extending around a periphery and mating with the flange of the retaining ring.

11. The modular unit or element as claimed in claim 1 wherein a plurality of modular units or elements as defined in claim 1 are attached to form a multi-unit building.

12. The modular unit or element as claimed in claim 11 wherein the plurality of modular units or elements are arranged in a generally triangular shape and walkways are positioned between adjacent modular units or elements.

13. The modular unit or element as claimed in claim 1 wherein the roof support structure includes a support rod and a support rod affixing element centrally located in the anchor collar and oriented in an upwardly oriented position, a lower end of the support rod attached to the support rod affixing element and an upper end attached to the roof.

14. A modular unit or element comprising:

a concrete pad having an upper surface;

a base support affixed to the upper surface of the concrete pad;

an anchor collar affixed to the base support, the anchor collar defining spaced apart grooves, the anchor collar including an upwardly directed wall extending around a periphery to define a depression in the center, the spaced apart grooves being cut into the wall down to a surface of the central depression so that bottoms of the grooves are in a common plane with a bottom of the depression, and a centrally located support rod affixing element is fixedly mounted at a center of the depression;

a multi-arm beam positioned in the anchor collar with one arm of the multi-arms positioned in each of the spaced apart grooves so as to extend radially outwardly from the anchor collar;

a plurality of floor sections affixed to the multi-arm beam, one each floor section of the plurality of floor sections affixed between adjacent arms of the multi-arm beam to form a floor disc for the modular unit or element, the floor disc defining an outer periphery of the modular unit or element;

a plurality of wall panels affixed to outer portions of the floor disc, the plurality of wall panels being spaced apart around the outer periphery of the floor disc and oriented in an upwardly directed position to define a peripheral wall around the floor disc, each wall panel of the plurality of wall panels having channeled edges on each opposite vertical edge;

a plurality of window inserts, one each engaged in opposed channeled edges of adjacent wall panels;

a retaining ring extending around the peripheral wall, the retaining ring having a downwardly opening groove engaged with an upper edge of each window insert and fixedly attached to an upper edge of each of the plurality of wall panels, the retaining ring having a flange extending at least partially around a periphery;

a roof support structure including a roof support rod having a lower end engaged with the centrally located support rod affixing element and an upper end extending vertically upwardly beyond the retaining ring; and a roof having a flange extending around the outer periphery and mating with and fixedly engaged with the retaining ring flange and the roof engaged with the roof support rod, the roof including a grid defining a ceiling for the modular unit or element.

15. The modular unit or element as claimed in claim 14 wherein the concrete pad is positioned in ground with the upper surface substantially parallel with surrounding ground level or surface.

16. The modular unit or element as claimed in claim 15 wherein the concrete pad includes a plurality of threaded studs embedded in the concrete pad and positioned in an upwardly extending orientation.

17. A method of constructing a modular unit or element comprising the steps of:

providing a concrete pad having an upper surface;

affixing a base support to the upper surface of the concrete pad;

affixing an anchor collar to the base support, the anchor collar defining spaced apart grooves;

positioning a multi-arm beam in the anchor collar with one arm of the multi-arms positioned in each of the spaced apart grooves so as to extend radially outwardly from the anchor collar;

affixing a plurality of floor sections to the multi-arm beam, one each floor section of the plurality of floor sections affixed between adjacent arms of the multi-arm beam to form a floor disc for the modular unit or element, the floor disc defining an outer periphery of the modular unit or element;

affixing a plurality of wall panels to outer portions of the floor disc, the plurality of wall panels being spaced apart around the outer periphery of the floor disc and oriented in an upwardly directed position to define a peripheral wall around the floor disc, each wall panel of the plurality of wall panels having channeled edges on each opposite vertical edge;

engaging a plurality of window inserts, one each in opposed channeled edges of adjacent wall panels;

attaching a retaining ring around the peripheral wall, the retaining ring having a downwardly opening groove engaged with an upper edge of each window insert and fixedly attached to an upper edge of each of the plurality of wall panels; and providing a roof and affixing a roof support structure to the roof, the roof including a grid defining a ceiling for the modular unit or element.

18. The method as claimed in claim 17 wherein the concrete pad is positioned in ground with the upper surface substantially parallel with surrounding ground level or surface.

19. The method as claimed in claim 18 wherein the concrete pad includes a plurality of threaded studs embedded in the concrete pad and positioned in an upwardly extending orientation.

* * * * *